United States Patent [19]

Gämmerler

[11] Patent Number: 4,889,333

[45] Date of Patent: Dec. 26, 1989

[54] CONVEYING APPARATUS FOR PAPER PRODUCTS, IN PARTICULAR IN STREAM FORM

[76] Inventor: Hagen Gämmerler, D-8021 Icking, Ichoring 44, Fed. Rep. of Germany

[21] Appl. No.: 160,275

[22] Filed: Feb. 25, 1988

[30] Foreign Application Priority Data

Mar. 9, 1987 [DE] Fed. Rep. of Germany ..... 3707540
Sep. 16, 1987 [DE] Fed. Rep. of Germany ..... 3731151

[51] Int. Cl.[4] ..... B65H 5/02

[52] U.S. Cl. ..... 271/272; 198/839; 271/185; 226/197

[58] Field of Search ..... 271/184, 185, 186, 272, 271/273, 274; 198/839; 226/197

[56] References Cited

U.S. PATENT DOCUMENTS

| | | | |
|---|---|---|---|
| 2,841,394 | 7/1958 | Stobb | 271/185 |
| 3,415,509 | 12/1968 | Tyburski et al. | 271/45 |
| 3,954,261 | 5/1976 | Greene et al. | 271/188 |
| 4,012,033 | 3/1977 | Parrish, II | 271/64 |
| 4,330,116 | 5/1982 | Newsome | 271/185 X |
| 4,512,562 | 4/1985 | Moll | 270/45 |

FOREIGN PATENT DOCUMENTS

| | | |
|---|---|---|
| 0160739 | 7/1984 | European Pat. Off. . |
| 0212246 | 7/1985 | European Pat. Off. . |
| 850989 | 9/1952 | Fed. Rep. of Germany . |
| 2636727 | 5/1977 | Fed. Rep. of Germany . |
| 2721138 | 1/1978 | Fed. Rep. of Germany . |
| 2854839 | 7/1980 | Fed. Rep. of Germany . |
| 2948290 | 6/1981 | Fed. Rep. of Germany . |
| 2538359 | 1/1983 | France . |
| 605363 | 9/1978 | Sweden . |
| 657115 | 8/1986 | Sweden . |

*Primary Examiner*—Richard A. Schacher
*Attorney, Agent, or Firm*—Paul L. Sjoquist

[57] ABSTRACT

A conveying apparatus for paper products in stream form having two parallel belt elements supported by rollers is made up of individual standardized self-contained prefabricated constructional elements which at least at a side lying in the product flow direction are couplable to a corresponding constructional unit in such a manner that only a single conveyor belt pair is provided which is supported by rollers or rolls and driven by a single drive unit, and at least one constructional unit is constructed for a deflection and/or turning of the product stream.

5 Claims, 5 Drawing Sheets

Figure 1:
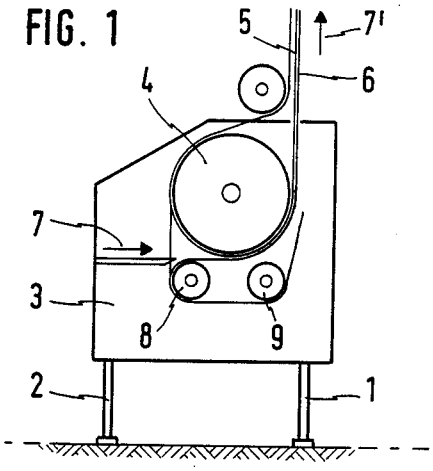

FIG. 10
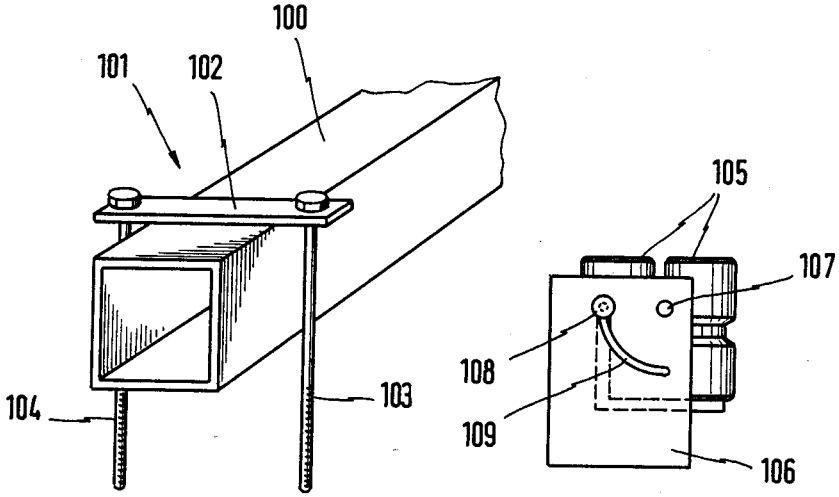
FIG. 11
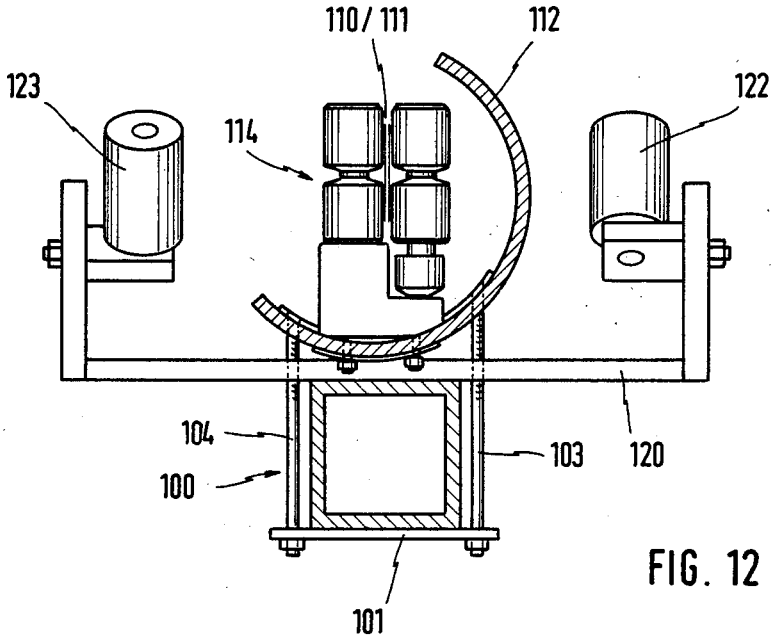
FIG. 12

CONVEYING APPARATUS FOR PAPER PRODUCTS, IN PARTICULAR IN STREAM FORM

The invention relates to a conveying apparatus for paper products, in particular in stream form, comprising two parallel belt elements supported by rollers, rolls or the like.

Conveying apparatuses for paper products are known in a variety of constructional forms; the paper products are engaged individually by clamps or by a conveyor belt pair; in the latter case the transfer from a belt unit, i.e. a module, to another constructional unit is by transferring from one conveying apparatus to another. Assembly of the individual models together is possible only by special adaptation at the "seams".

The invention is based on the problem of providing a conveying apparatus of the type mentioned at the beginning which can be made in particularly economic manner, employed depending on the space conditions or the requirement for bridging direction changes and possibly also for turning over and is simple to set up.

This problem is solved in that according to the invention the apparatus is made up of individual standardized prefabricated constructional components which are self-contained and are couplable at least at a side lying in the product flow direction to a corresponding constructional unit, that only a single conveying belt pair supported by rollers or rolls and driven by a single drive unit is provided and that at least one constructional unit is configured for a deflection and/or turning of the product flow.

The intention here is to make it possible to assembly a conveying apparatus in any desired manner, the individual constructional units of which have been prefabricated, by combination of such constructional units in accordance with the transport requirements for the product flow and the space conditions.

According to a preferred embodiment of the invention the constructional units are each about 1.0 to 1.5 m long.

At least one roller, roll or the like of each roller or roll pair may be adjustable or movable in a direction perpendicular or approximately perpendicular to the product flow; preferably, the roller, roll or the like is resiliently mounted via links or the like.

According to a preferred embodiment of the invention the rollers, rolls or the like of a constructional unit are mounted in or on a frame, a tunnel-shaped housing or the like and the frame, the housing or the like has coupling members or the like adapted to the adjacent constructional unit. This makes it possible for the tunnel-like housing to have at least at one side a flange or the like which is connectable to the flange of the adjacent constructional unit by screws, bolts or the like. Accordingly, the individual constructional units are so constructed that at their free sides they can be coupled in simple manner to adjacent constructional units having the same function or a different function, for example turning, deflecting or the like.

Since the conveying apparatus after the assembly of the individual constructional units forms a self-contained conveying apparatus "of any desired length" and "of any desired height", according to a preferred embodiment it is suggested that a special constructional unit be provided for the entry and a special constructional unit for the exit of the paper products and that one of these two constructional units carries the drive motor for the conveyor belt pair.

In the constructional unit provided for the turning particularly small rollers, rolls or the like may be provided in close axis spacing. In the constructional unit provided for the deflection conveniently at least one roller, roll or the like is provided having a substantially greater diameter than the rollers, rolls or the like for the straight guiding of the product stream.

Two rollers, rolls or the like arranged on one side of the product stream can be combined in a single constructional unit to form a pair.

Also, the frame carrying the rollers or rolls or the like can carry on one side of the product flow a resiliently mounted roller or roll pair and on the other side of the product flow a stationary roller or roll pair.

According to a preferred embodiment of the invention for coupling the constructional unit a preferably unround tube, a rod or the like of different length is provided to which the individual constructional units, the rollers and/or roller pairs can be attached via clamp means; the clamp means may each consist of a flange and a bolt pair and surround the tube, the rod or the like in yoke-manner.

The means for turning the product stream comprises preferably a bent sheet metal plate constructed as holding plate and having slots which extend transversely of the product flow direction and in which the roller pairs are adjustably held.

The roller or roll pairs may be adjustable via a rod or the like in each case individually in the arcuate preferably quadrantal slot of the holding plate. Brackets or the like may be arranged on the holding plate perpendicularly to the longitudinal axis thereof and carry at their free ends roller or roll pairs; the brackets arranged at the two ends of the holding plate are preferably offset perpendicularly with respect to each other; the slots may have equal spacings.

According to a preferred embodiment the means for deflecting the product stream comprises a holding plate on the one side of which all the rollers or roll pairs are disposed; the holding plate is expediently provided with slots for adjustable arresting of the rollers or roll pairs. Also, on the entry and exit side of the holding plate pivotal roller pair carriers may be provided. Conveniently, the roller pair carriers each comprise at least one roller or roll pair, a single deflecting roller and deflecting rollers for the returning belt element sections.

It is also possible to provide on the holding plate three deflection rollers for an endless auxiliary belt element and to provide for the outer belt element in the region of the latter at least one deflection roller.

Preferably, the conveyor belt pair engages the paper products on one side.

Figure 6:
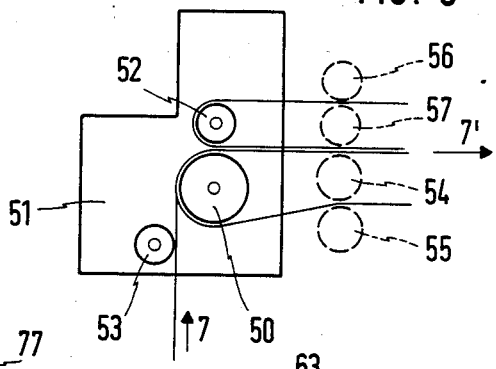
Figure 7:
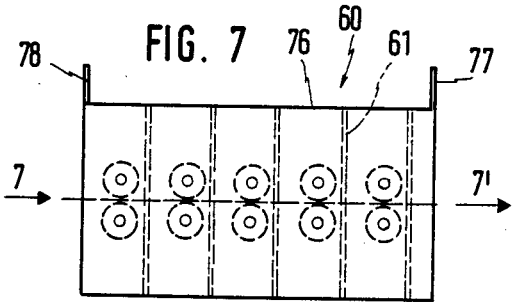
Figure 9:
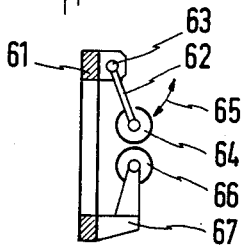
Figure 8:
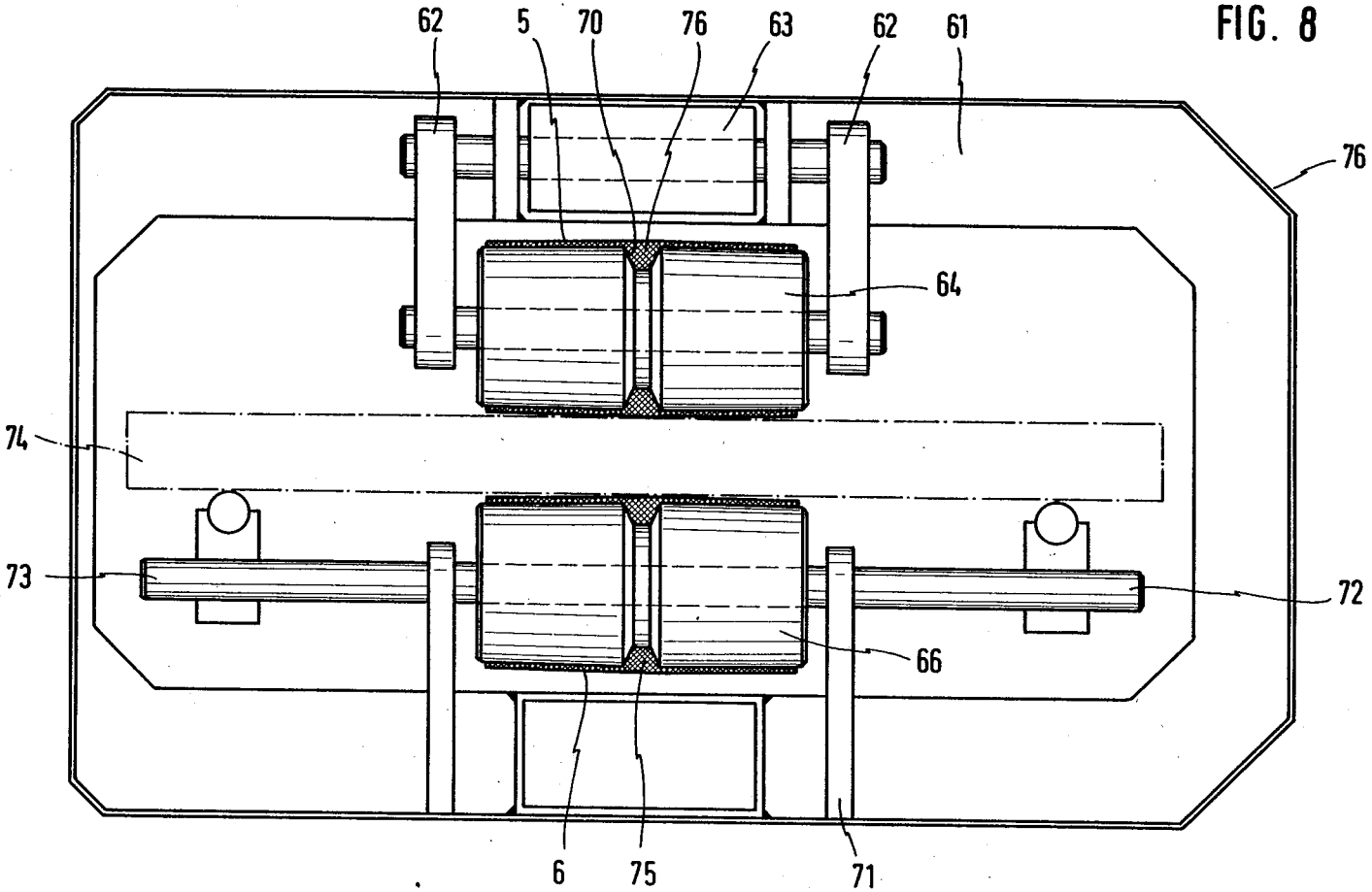
Figure 13:
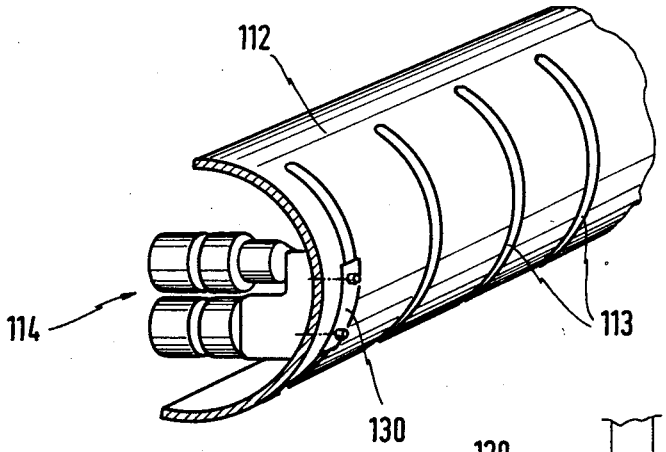
Figure 14:
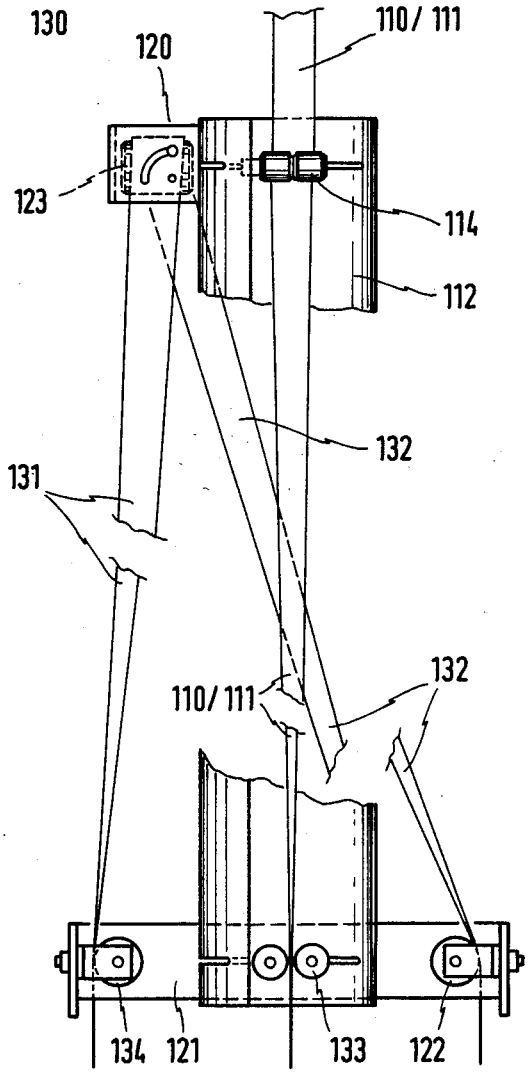
Figure 15:
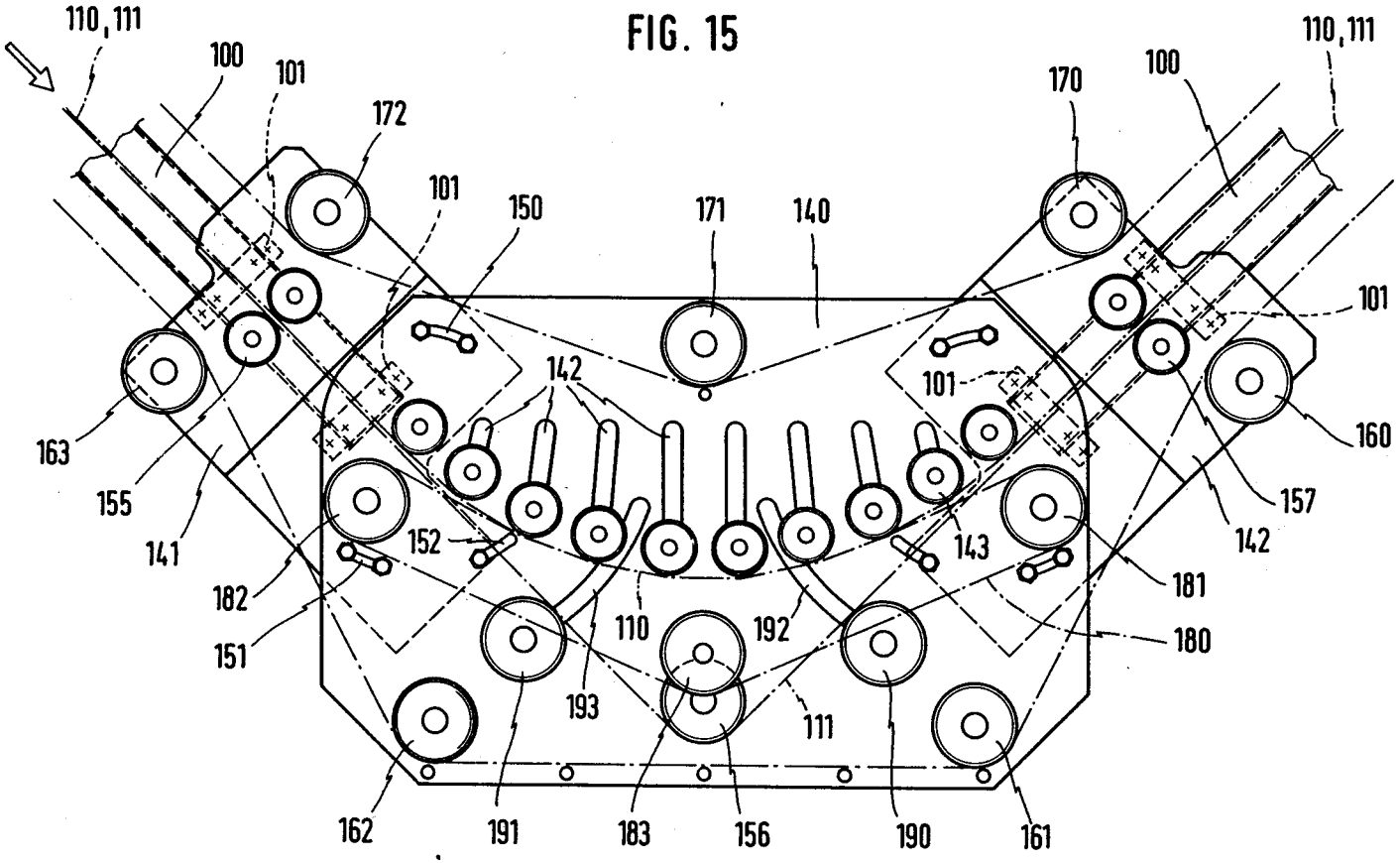

Hereinafter examples of embodiment of the invention will be described in details with the aid of the drawings, wherein:

FIGS. 1 to 7 show different constructional units in a highly schematic illustration, FIG. 8 shows an embodiment of a roller pair with its frame in longitudinal section, FIG. 9 is a detail of a modified embodiment, FIG. 10 is a detail of a modified embodiment in perspective view, FIG. 11 is a further detail in plan view, FIG. 12 shows a cross-section through a further embodiment of the invention, FIG. 13 is a perspective view of part of the embodiment of the invention illustrated in FIG. 12, FIG. 14 is a detail to a reduced scale of the embodiment of the invention illustrated in FIG. 12 and in FIG. 13 and FIG. 15 is a plan view of a further embodiment of the invention.

A conveying apparatus may be made up of individual standardized constructional units each provided with coupling members. Different vertical levels may be overcome therewith; it is possible to deflect the product stream through 90° or even 180°; it is also possible to turn over the product stream. A special constructional unit is provided for each one of these functions; these constructional units are then put together in accordance with the requirements in situ, the two belt elements subsequently been drawn in and connected together.

Some examples of such constructional units, which may have for example a length of 1 m or 1.50 m, will be described in detail hereinafter.

A frame 3 placed on feet 1 and 2 carries a large roller 4 about which the two belts 5, 6 are guided. The product stream supplied in the direction of the arrow 7 and consisting of paper products in stream form is engaged above the roller by a conveyor belt 6 and by the drive of the belt 6 pushed into the pinch between the belt 6 and the belt 5. Thus, whereas the belt 5 is wrapped round the large roller 4 the belt 6 runs round the rollers 8 and 9 and then upwardly in the conveying direction 7'.

It is obvious that a corresponding laterally inverted embodiment of the roller arrangement would result in the paper products being conveyed downwardly instead of upwardly.

Figure 2:
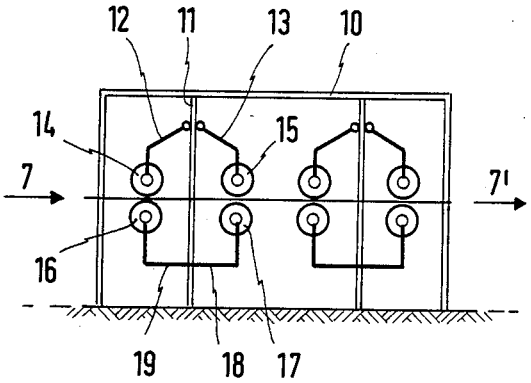

In FIG. 2 a constructional unit is shown for straight conveying of the paper products in stream form and it is also possible to provide this constructional unit in vertical arrangement.

In a tunnel-like housing 10 in the embodiment illustrated two frames 11 are mounted and each carry via links 12, 13 a roller 14 and 15 respectively. The links are resiliently mounted so that the rollers can adapt themselves to the product thickness; possibly, adjustability of the roller pair may also be provided.

Beneath the product stream two rollers 16, 17 are connected immovably to the frame via rods 18 and 19 respectively.

The two parallel extending conveyor belt sections are not shown.

Figure 3:
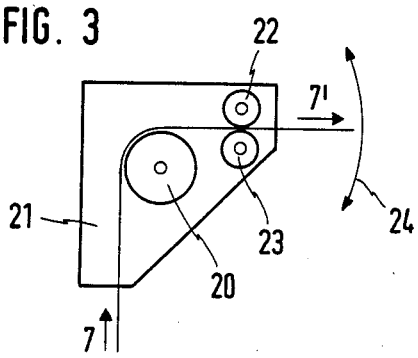

In the embodiment illustrated in FIG. 3 of a constructional unit for deflecting the product flow a large roller 20 is provided which is arranged in a frame 21 and as illustrated permits deflection of the product flow 7 through 90°.

The roller pair 22, 23 is arrestable at various locations in the frame 21 as indicated by the arrow 24 so that the outgoing angle of the roller 20 can be adjusted for example in one case between 55° and 90° whilst with a similar arrangement but in another frame the outgoing angle can be adjusted between 20° and 55°.

It is obvious that the constructional unit illustrated in FIG. 3 can be modified so that a deflection in any desired direction is possible.

Figure 4:
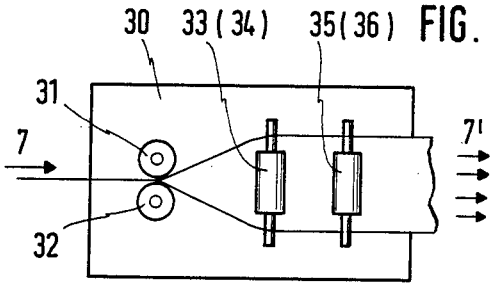

The embodiment of a constructional unit illustrated in FIG. 4 includes in a tunnel-like housing 30 at least one roller pair 31, 32, whereafter a turning of the product stream through 90° is produced by small roller units which are not further illustrated. After effecting a turning, roller pairs 33, 34 and 35, 36 are provided which transport the product stream after turning through 90°.

Figure 5:
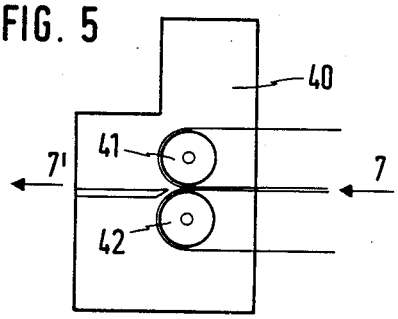

The constructional unit illustrated in FIG. 5 is the so-called exit station in which in a housing or frame 40 at least one roller pair 41, 42 is provided, at least one of said rollers 41 and 42 being driven by a drive unit, for example an electric motor. Even if independently of the number of constructional units installed over the entire conveying distance only one single conveyor belt pair extends no further drive is provided in the entire conveying apparatus. Whether and to what extent the roller 41 must also be driven synchronously depends on the particular conditions. Thus, a synchronizing circuit may also be provided for driving the conveyor belt which runs round the roller 41.

FIG. 6 shows a further embodiment for deflection of the product stream into the horizontal after a rising conveying. In this embodiment apart from a large deflection roller 50 in the housing 51 a small deflection roller 52 is provided. The supporting of the two conveyor belts before contact with the deflection roller 50 is by a further roller 53.

Arranged outside the housing 51 is a roller pair 54, 55 with equisize rollers and a roller pair 56, 57 also with equisize rollers.

In FIG. 7 a constructional unit 60 for example 1.50 m long and provided with a protective enclosure is shown for straight conveying; said constructional unit 60 comprises as indicated for example in dashed lines five roller pairs each mounted on a frame. Such a frame is shown in side elevation in FIG. 9. These frames 61 are adapted to the outlines of the protective enclosure or also of the tunnel-like housing; the frame comprises links 62 which are resiliently mounted in a housing 63 and permit adaptation of the roller 64 according to the arrow 65 to the thickness of the product stream.

The roller 66 is fixedly connected to the frame via a fixed linkage 67.

Such a frame is shown in a greatly enlarged illustration in FIG. 8.

This substantially tetragonal frame carries the housing 63 in which the links 62 are resiliently mounted. The links carry the roller 64 which comprises in the center an annular groove 70. The roller 66 is fixedly connected via the connecting rods 71 to the frame 61. The shaft of the roller 66 is laterally extended and forms supports 72, 73 for supporting the stream-like product flow 74.

The individual belts 5 and 6 are each provided at their inner side with a continuous guide rib 75 and 76' which prevents a lateral yielding of the two conveyor belts 5 and 6. The frame is provided with a protective enclosure 76 which extends over the entire length of the constructional unit. The protective enclosure may be constructed so that it carries the frames 61 without additional struts being provided. The protective enclosure 76 is provided with flanges 77 and 78 which can be connected to corresponding flanges of the adjacent constructional unit, for example by threaded bolts.

Instead of the protective enclosure, which is not always necessary, the frames 61 may be connected together by a linkage or by plates; in each case however a coupling facility is to be provided at least at one side of the respective constructional unit; said coupling facility is a basic condition for the use of the individual constructional units which are prefabricated in the factory and put together in situ. As already mentioned above after assembling the entire conveyor unit the belts 5 and 6 are drawn in situ and then for example welded together.

FIG. 10 shows a means for coupling the individual constructional units in perspective view; it is used in various lengths for connecting the constructional units. On the other side said means can also itself serve as support for roller sets, whether individual rollers or roller pairs, particularly when the product flow is to be guided rectilinearly.

This means consists of a square tube 100 which can be secured to the individual constructional units or a frame, chassis or the like with a yoke-like clamp means 101. The yoke-like clamp means consists of a rod 102 and two threaded bolts 103 and 104.

As apparent from FIG. 11 a roller pair 105 is pivotally mounted on a holding plate 106. Since the roller pair is held beneath the holding plate via an L-shaped profile pivoting around the bolt 107 through 90° is possible, a lock screw 108 connected to the angle iron being displaceably mounted and lockable in a quadrantal slot 109.

This adjustable roller pair is attached individually possibly to the tube 100.

The embodiment according to FIGS. 12 to 14 represents a means for turning the belt elements 110, 111, a sheet metal plate 112 bent through 180° and extending perpendicularly to the plane of the drawing being provided with slots 113 which are distributed with equal spacing over the entire length of the shell-shaped sheet metal plate and each provided for receiving a roller pair set 114. The slots 113 are arranged such that the individual roller sets 114, as will be described in detail below, can be arrested with their respective axes offset with respect to each other.

The shell-like sheet metal plate 112 is incorporated into the conveyor system by means of the tube 100 and the yoke-like clamp means 101 and comprises at its free ends brackets 120 and 121 respectively. The longitudinal axes of the brackets extend at right-angles to each other. The brackets carry at their respective leg ends individual rollers 122 and 123 which serve to deflect the outer band sections or belt sections of the respective endless bands or endless belts.

As already pointed out above for the entire conveying apparatus only two endless belts are used which are driven from one point, for example from the entry point of the product stream of the stream-like paper products.

In the embodiments of the invention illustrated in FIGS. 10 to 15 all the roller pairs of the entire conveying apparatus are provided on one side thereof and receive the product stream of the stream-like paper products only at the edge so that part of said paper products or of the stream flow projects out laterally. The product stream is guided by the two adjacent sections of the inner and outer belt elements up to the exit except for the sections described below in the so-called curve pieces. The returning sections of the two belt elements are guided rectilinearly or deflected at a distance from the roller pairs, partially on individual rollers.

As apparent from FIG. 13 the shell-like sheet metal plate 112 comprises a large number of curved slots which extend however perpendicularly to the longitudinal axis of the plate and which each serve to receive a holder pair 130 of the roller pairs. As already mentioned above, over the entire length of the sheet metal plate the roller pair offsetting may be such that the axes of the roller pair at the entry forms for example a right-angle with the axes of the roller pair at the exit.

In FIG. 14 to a reduced scale a sheet metal plate arranged in vertical direction is provided at the entry end of the two belt or band sections 110, 111 with a roller pair whose axis of rotation extends parallel to the plane of the drawing. The bracket 120 also carries an individual roller 123 having an almost parallel axis. Said roller serves for deflection of the returning belt section 131. At the opposite end of the bracket 120 a further individual roller is provided whose axis also extends parallel or approximately parallel to the axis of the roller pair 114 and deflects the returning section of the belt or band element 132. At the lower end of the sheet metal plate 112 the roller pair 113 is provided in each case with axes of rotation perpendicular to the plane of the drawing. Similarly, the individual rollers 122 and 134 are mounted on shafts whose axes of rotation extend approximately parallel to the axes of rotation of the rollers of the pair 133.

Since the individual roller pairs may be arrested at any desired position within the longitudinal slots it is of course also possible for a rectilinear or almost rectilinear guiding of the belt element pairs to take place in the region of the sheet metal plate.

The embodiment of a curve piece or device for deflecting the product stream between the belt sections 110, 111 shown in FIG. 15 consists of a plate 140 to which a pivotal plate 141 or 142 is secured. At the lower side of the holding plate 140 the rectangular tubes 100 are secured with the yoke-like clamp means 101 so that the curve piece is included in the conveying system with the coupling means described above.

The holding plate 140 comprises slots 142 of different length within which the mounting of the individual rollers 143 is effected for upward adjustment in the plane of the drawing. In this manner the holding plate 140 can be used not only for the deflection of the product stream of stream-like paper products through 90°, as illustrated, but also for a deflection through a greater arc angle. The pivot plates 141 and 142 are rotatable; for this purpose slots 150, 151 and 152 are provided, the length of the arcuate slots defining the pivoting possibility. Arresting of the pivot plates 141, 142 in said slots is possible in infinitely variable manner.

Since the inner belt element or band element 110 in the curve piece is somewhat shorter than the outer belt element 111 in the region of the curve it must be ensured that no shifting of the product stream occurs. For this purpose the outer band or belt element 111 coming from the roller pair 155 is led to a deflection roller 156 and then again to the roller pair 157.

The return of the outer band or belt element is via the deflection rollers 160, 161, 162 and 163.

The return of the inner band or belt element 110 is via the deflection rollers 170, 171 and 172.

To ensure that in the region of the curve as well the product stream is held undisplaceably an auxiliary band element, a so-called rider belt 180, is provided which is guided as endless belt round three deflection rollers 181, 182 and 183.

Tensioning rollers 190 and 191 are adjustably guided in slots 192, 193.

I claim:

1. A conveying apparatus for paper products wherein endless belts are guided so as to propagate the products, the apparatus having adjustable features to provide for guiding endless belts so as to turn the propagated products about the propagation axis, comprising a plurality of conveying assemblies, each assembly comprising a housing having two parallel, spaced-apart shafts attached thereto, and rotatable rollers on each shaft, spaced apart sufficiently to guide products therebetween; an elongate plate having a transverse curvature, and a plurality of transverse slots extending at least partially along said transverse curvature; and means for adjustably mounting each of said plurality of conveying assemblies to said elongate plate in predetermined positions along said transverse slots.

2. The apparatus of claim 1, wherein said conveying assembly housings each further comprise an attachment surface shaped to conform to the curvature of the elongate plate.

3. The apparatus of claim 1, wherein said means for adjustably mounting further comprises a curved bracket having fasteners therethrough, said bracket being curved to conform to the curvature of the elongate plate.

4. The apparatus of claim 2, wherein said conveying assembly housings each further comprise an attachment surface shaped to conform to the concave curvature of the elongate plate.

5. The apparatus of claim 4, wherein said means for adjustably mounting further comprises a curved bracket having fasteners therethrough, said bracket being affixed against the convex surface of said elongate plate, and said fasteners extending through said transverse slots and attaching to said conveying assembly housing.

* * * * *